United States Patent [19]

Rush et al.

[11] 3,965,695

[45] June 29, 1976

[54] METALLIC SENSIBLE HEAT EXCHANGER

[75] Inventors: William F. Rush, Arlington Heights; Robert A. Macriss, Deerfield; Sanford A. Weil, Chicago, all of Ill.

[73] Assignee: Gas Developments Corporation, Chicago, Ill.

[22] Filed: June 12, 1975

[21] Appl. No.: 586,243

[52] U.S. Cl. ..... 62/271; 165/10

[51] Int. Cl.[2] ..... F28D 19/00; F25B 13/00

[58] Field of Search ..... 165/10, 4, 8; 62/271

[56] References Cited

UNITED STATES PATENTS

| | | | |
|---|---|---|---|
| 1,776,162 | 9/1930 | Martinka | 165/10 |
| 3,252,506 | 5/1966 | Huebner, Jr. | 165/10 |

FOREIGN PATENTS OR APPLICATIONS

| | | | |
|---|---|---|---|
| 1,077,508 | 5/1954 | France | 165/10 |

*Primary Examiner*—Albert W. Davis, Jr.
*Attorney, Agent, or Firm*—Thomas W. Speckman

[57] ABSTRACT

Improved metallic heat exchange apparatus particularly useful in a wheel-like form as a sensible heat exchange wheel in an environmental control apparatus. The heat exchange apparatus is constructed of multiple layers of metallic "honeycomb", with the apertures of the honeycomb layers axially parallel and offset with respect to each other. The multiple layers provide thermal discontinuities so that the face to face temperature gradient of the heat exchanger is continuous. The heat exchange apparatus of this invention is fireproof, a serious deficiency in prior art wax-coated sensible heat exchange wheels used in environmental control apparatus.

10 Claims, 4 Drawing Figures

METALLIC SENSIBLE HEAT EXCHANGER

This invention relates generally to improved heat exchange apparatus, and more particularly to multilayer wheels of metallic honeycomb construction which are particularly useful in environmental control apparatus. The metallic sensible heat exchange wheels of this invention are fireproof, and have good heat exchange properties with less pressure drop and concomitantly low blower power requirements as compared to prior art wheels. The metallic wheels of this invention are simple to construct, and lightweight, which lends to improved power efficiency of the machine.

Environmental control systems of the open-cycle type are air conditioning units for cooling and heating wherein moisture and heat are transferred from one air stream to another using elements which move cyclically between the air streams. Air conditioning apparatus and methods of the open-cycle type are generally disclosed in U.S. Pat. No. 2,723,837, Neal A. Pennington and U.S. Pat. No. 2,926,502, C. G. Munters et al., among others. In such apparatus and methods a treatment air stream to be conditioned passes through an air-permeable drying wheel of a hygroscopic material which absorbs moisture from the air substantially adiabatically (L-wheel). The dried treatment air stream at an elevated temperature then flows through a rotating heat exchanger whereby it is cooled by removal of sensible heat (S-wheel). The dried and cooled treatment air stream is then further cooled to the desired temperature and reconstituted to a desired humidity by evaporating water therein. The hygroscopic material of the drying wheel and the thermal properties of the heat exchanger are cyclically regenerated by a regenerative air stream.

During regeneration, the regenerative air stream is first cooled by evaporative cooling and then passed through the heat exchanger thereby cooling the latter. Thereafter, the regenerative air stream is heated by means of an external heat source to a temperature sufficiently high to regenerate the hygroscopic material of the drying wheel, passed in thermal exchange relation to the hygroscopic material, and then discharged into the atmosphere. The heat source is frequently an open flame between the heat exchanger and the moisture exchanger.

Typical types of S-wheel constructions are shown in U.S. Patents to Pennington, U.S. Pat. No. 2,464,766, 2,563,415, 2,700,537, 2,809,817 and Axelsson, U.S. Pat No. 3,155,153.

In prior art open-cycle type air conditioning units, the sensible heat exchange wheels (S-wheels) have been constructed of a material, such as asbestos paper, which has been coated with microcrystalline wax or other chemicals. The wax coating prevents the adsorption or absorption of water vapor thereon from humid air passing therethrough. However, the close proximity of the open flame heater section to the S-wheel creates a serious fire hazard due to the high temperatures and the flammability of the microcrystalline wax coating on the S-wheel material. The S-wheel may itself catch fire causing the room to fill with smoke and failure of the unit.

Although many attempts to solve these problems have been tried, including separating the S-wheel from the burner section, no single solution has been entirely satisfactory. Separation of the S-wheel from the burner makes the machine considerably more bulky.

Operation of wheels as heat exchangers depends in large part on the opposite faces remaining at different temperatures. That is, there must be a significant temperature gradient across the wheel in the axial direction. This requirement is well satisfied by asbestos and/or asbestos coated with wax since it is a low thermally conductive material and is suitable for use with one face being at a different temperature than the other face. Using the same construction where the material is thermally conductive, such as metal, results in the temperature gradient through the wheel being substantially less with poorer heat exchange and lower efficiency.

In the open-cycle air conditioner, the heat from incoming air in the air stream to be treated must be removed by the S-wheel. However, migration of the heat axially in the direction of flow of the air through the wheel must be kept to a minimum. If the heat does so migrate, the air stream to be treated exiting from the wheel will not be sufficiently cooled. The treated air stream would flow into the room relatively dry but hot.

Non-thermally conductive wheel materials such as wax coated asbestos have previously been used since they don't present these problems. The high thermal conductivity makes metallic materials seem unsuitable as a material for wheels. This is readily apparent in view of the thermal conductivity of aluminum being 130 BTU/hr. — $ft^2$ — °F/ft. while that of asbestos is near zero.

While the face-to-face thermal gradient across a metallic heat exchanger might be partially counteracted by making the heat exchanger thicker, the increased thickness causes a proportionally increased pressure drop and undesired bulkiness. To obtain comparable heat exchange in an aluminum wheel of the same design as the asbestos wheel the thickness would have to be increased due to the difference in thermal conductivity. The pressure drop would also be proportionately increased.

The maintenance of a suitable temperature gradient across the S-wheel of an open-cycle air conditioner is extremely important since the wheels must operate at above 90 percent efficiency to provide satisfactory cooling of the treatment stream. Standard efficiency calculations shows that a wheel of continuous metal, similar in design to the present asbestos wheels, would have an efficiency less than 3 percent and thus be totally unsuitable for use as a heat exchanger according to the requirements set out above.

It is among the objects of this invention to provide a metal heat exchanger that overcomes the problems set forth above, and is fireproof, yet has high efficiency.

It is another object of this invention to provide a special metal construction for a heat exchanger and in particular, a wheel useful as an S-wheel in an environmental control apparatus.

It is another object of this invention to provide an improved sensible heat exchange wheel which is relatively lightweight.

It is another object of this invention to provide an improved S-wheel useful in an environmental control unit which is fireproof and has satisfactory heat capacity and high efficiency performance while the surface has low water adsorption.

It is still another object of this invention to eliminate the health hazards concomitant with the use of asbestos in heat exchangers.

These and other objects will be evident from the detailed description and the figures showing preferred embodiments and wherein like numerals indicate like or similar parts throughout.

Figure 1:
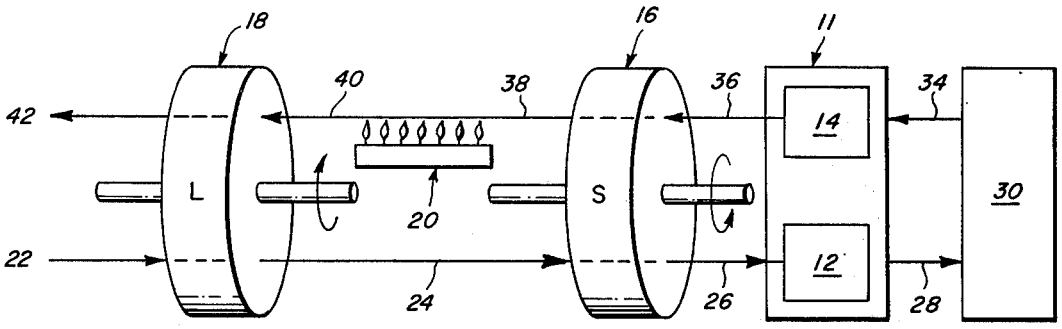
FIG. 1 illustrates the layout in schematic form of an open-cycle environmental air conditioning apparatus suitable for use in this invention.

Referring now to FIG. 1, there is shown an open-cycle solid-adsorbent air conditioning system suitable for use in this invention. Such systems are useful for the control of temperature and moisture conditions in air to be drawn from the outside and circulated in a space to be conditioned, typically a room 30, or they may be operated by fully recirculating the air from room 30, or a combination of ventilating and recirculating. The system is diagrammatically illustrated, with duct work and fans or blowers needed for circulating the air being removed for clarity. It is to be understood that each of the systems described includes appropriate duct work, where required, defining separated flow paths for the air to be conditioned and the regenerative air required. This duct work is arranged in a well known manner to expose the various streams of air to appropriate segment portions of the elements of the system.

The typical system comprises four sections: an evaporating section 11 including evaporators 12 and 14; a heat transfer wheel (S-wheel) 16 for transfer of sensible heat from one air stream to the other; moisture transfer wheel (L-wheel) 18 for transfer of water and the latent heat of condensation; and a heating section 20.

The open-cycle air conditioning system is shown in FIG. 1 in the full ventilation mode. Outside air stream 22 to be treated is introduced into a segment of the rotating L-wheel 18 by a fan (not shown). Moisture in the treatment air stream is sorbed adiabatically by the hygroscopic material impregnated in the L-wheel with the latent heat of condensation being taken out by the treatment air stream thus resulting in an air temperature increase in the stream identified by the numeral 24. Incoming air is therefore heated and dehumidified in the L-wheel. Stream 24 is then passed through a segment of the rotating S-wheel 16 which is relatively cool, and the air and the air is cooled with substantially no change in moisture content. From the S-wheel 16 the relatively cool, relatively dry air stream 26 passes over the evaporator pads 12 (E-pads). Water is evaporated into the air and the air is humidified, with the latent heat of vaporization being extracted from the air by the water in the E-pads cooling the air and the resultant cooled air stream 28 passed into room 30. Typically, the conditioned air delivered to the room is at a lower dry bulb temperature than the outside air, with about 95 percent relative humidity.

In the regenerative portion of the cycle air stream 34 from the room is passed over evaporator pads 14. The air is cooled while the water is evaporated from the pads. The resultant cool, relatively moist air stream 36 is then passed over a warm segment of S-wheel 16 which has rotated into position and the S-wheel is cooled thereby. All or part of the moist, heated air stream 38 from S-wheel 16 then passes through the burner section 20 where its temperature is increased.

The heated air stream 40 from the burner section is then passed over the wet portion of the L-wheel which is regenerated thermally and with respect to moisture by the hot gases which are relatively dry due to the very high temperature of the air after passing through the heating section. The air after passing through the L-wheel and regenerating it is rejected to the outside by stream 42 completing the cycle.

Figure 2:
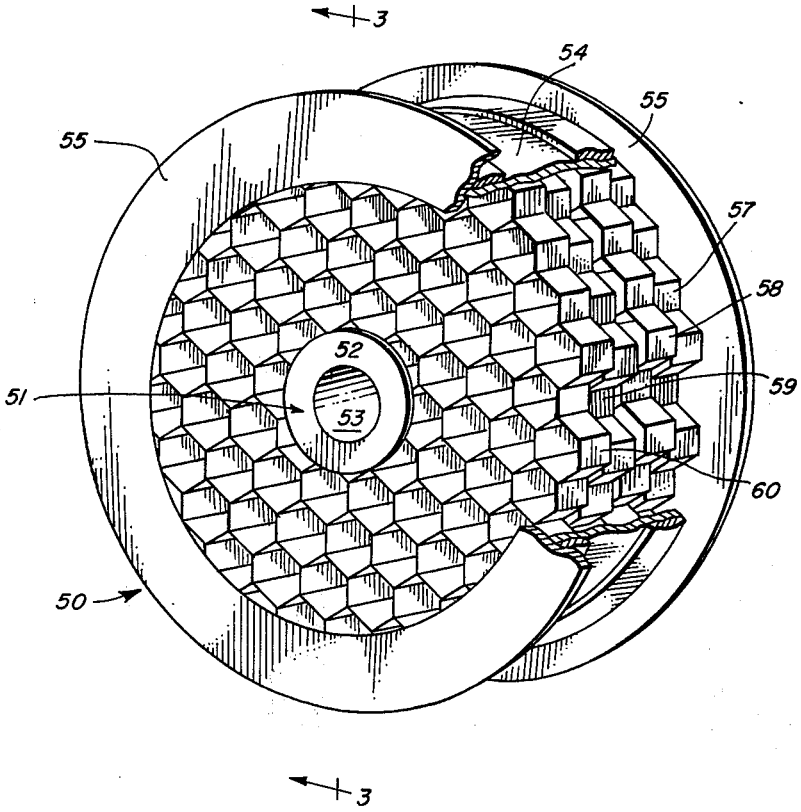
FIG. 2 shows in partial cut-away perspective a wheel of construction of one embodiment of our invention.
Figure 3:
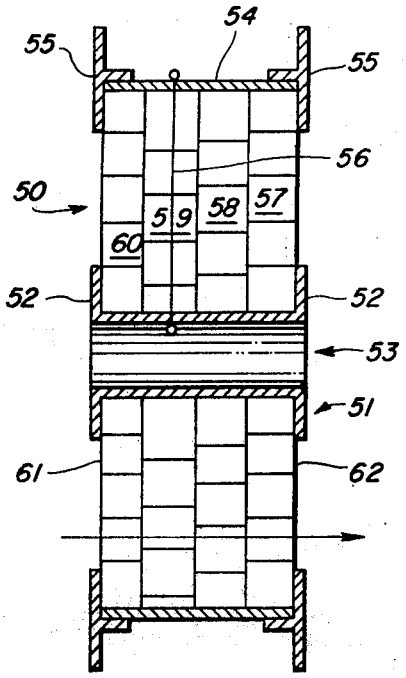
FIG. 3 is a section view along line 3—3 of FIG. 2.

The improved regenerative metallic heat exchanger of our invention is shown in FIGS. 2 and 3, in perspective and section, respectively. In general, the material of our construction is characterized as a honeycomb of thin metal of about 2 to 15 mils in thickness. About 3 to 6 mils is particularly preferred. Any suitable metallic material may be used, nonferrous metals being preferred since they are not corroded by moisture in the air streams. Aluminum, copper and alloys such as brass are preferred. Aluminum, due to its weight characteristics, is especially preferred. However, aluminum oxide formed on the surface is undesirably hygroscopic. This may be overcome by suitable surface treatment. For example, we have found aluminum treated with Duracote (a product of American Cyanamide Corp.) is satisfactory and provides the required hydrophobic properties. Any surface treatment providing hydrophobic properties is suitable.

FIGS. 2 and 3 show the improved metallic sensible heat exchanger of our invention in the form of a wheel showing details of the construction and juxtaposition of the honeycomb layers. It must be recognized that the heat exchanger of our invention can be of any desired shape such as square, rectangular, or other desired shape. The specific embodiment shown in the form of a wheel is particularly suitable for use as a regenerative sensible heat exchanger in an air conditioner. Referring to both FIGS. 2 and 3, wheel 50 has 4 layers of aluminum honeycomb 57, 58, 59 and 60 retained by retaining means comprising a central hub 51 and outer annular rim 54. In this embodiment, hub 51 has a central aperture 53 for receiving the shaft with which the wheel rotates. Aperture 53 may be enlarged to provide a bypass air passage therethrough, if desired. Hub 51 and rim 54 have flanges 52 and 55, respectively, for retaining the layers of the aluminum honeycomb.

As seen best in FIG. 2, the honeycomb layers 57, 58, 59 and 60 are placed into "just touching" contact with each other. They do not crush the faces of the adjacent layers, but also do not leave a substantial gap therebetween which permits lateral sag or curvature of the layers. An alternative embodiment may employ radial wire spokes 56 shown in FIG. 3 between inner hub 51 and outer rim 54 to help prevent sag. The minimal contact between layers creates thermal discontinuities so that the temperature gradient between outer face 61 of honeycomb layer 60 and outer face 62 of honeycomb layer 57 is maximized. The contact between adjacent layers must be a point contact and not a linear contact.

The honeycomb layers are formed to provide passages in the S-wheel oriented parallel to the axis of the wheel itself. In the honeycomb shape shown, the passages may be formed by methods known to the art. Honeycomb hexagonal shaped contiguous cells, with opposite walls being about one thirty-second to three-eighths inch from each other are suitable. One-sixteenth to one-eighth inch is a particularly satisfactory range of cell size. Suitable S-wheels are typically about 4 to 10 inches thick in the axial direction and may have a radius dependent upon the desired capacity. It must be recognized that the honeycomb cells may be of any suitable shape to maximize heat exchange while minimizing pressure drop. Hexagonal are preferred, but sinusoidal, as in the prior art asbestos wheels, is suitable as is square, rectangular and polyagonal variations. Round is not preferred due to the inefficient packing.

We have discovered that the loss of efficiency which would be associated with a continuous metal wheel can be overcome by providing a multi-layered wheel, preferably of three and more layers of honeycomb metal having axially parallel offset apertures. We prefer the use of four to eight layers of honeycomb metal. While our earlier considerations suggested thermal discontinuity barriers between the metallic layers, such as asbestos inserts sandwiched between each metallic layer, we discovered such insulating inserts are not necessary. We have discovered that the loss in efficiency decreases with an increase in the number of layers for a given hydraulic diameter of the axially parallel offset apertures through the wheel. For a wheel having four layers, the loss in efficiency is less than 1 percent.

With the multi-layer metal wheels of this invention we have surprisingly found no substantial increased pressure drop or corresponding increase in blower requirements where the apertures of successive layers are axially misaligned as compared with a continuous metal wheel. The thermal discontinuity between layers is enhanced by random axial misalignment because the contact of adjacent layers is point-to-point rather than edge-to-edge. The total contact area is thus minimized and increases the thermal discontinuity between layers.

Figure 4:
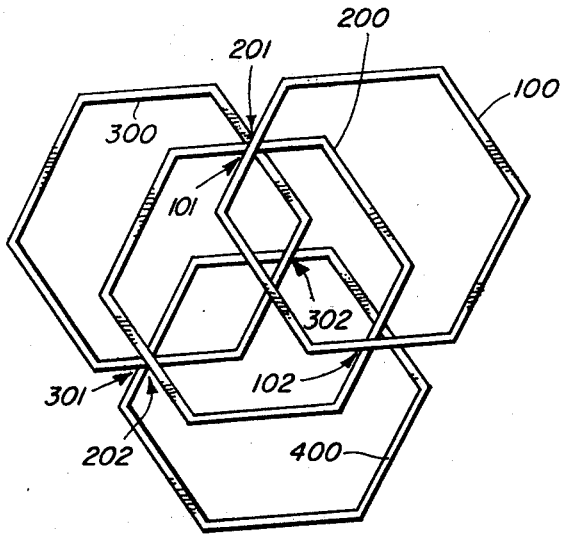
FIG. 4 is a detail of the face of the wheel shown in FIG. 2 showing the point-to-point contact of the layers.

FIG. 4 is a detail of a front view of a typical multilayer honeycomb wheel of our invention showing edge-on the point-to-point overlap contact. Front layer cell 100 contacts second layer cell 200 at points 101 and 102. Second layer cell 200 contacts third layer cell 300 at points 201 and 202. Third layer 300 contacts fourth layer cell 400 at points 301 and 302, and so on.

It cannot be over-emphasized that the metallic construction of our wheel is fireproof removing any danger of damage when used in close association with an open flame. In addition, the wheels of our invention are not hygroscopic which is necessary for use as S-wheels in open-cycle air conditioners. The wheel layers of our invention may be made from clean, smooth surface metallic sheets or foil of the dimensional and thermal characteristics mentioned hereinabove. The foil may also be pre-treated, or the wheel post-treated to improve heat absorption and water vapor repellency characteristics.

While we have made reference throughout to the material in layers, it should be understood that they are not merely metallic layers, but thermal discontinuities. The metallic honeycomb must be arranged so that the cells of one layer make only point-to-point contact with the cells of adjacent layers. This is achieved by axial misalignment of adjacent honeycomb layers. A metallic honeycomb wheel of "layers" having axial alignment of the cells of adjacent layers, does not solve the problems solved by our invention. Heat exchangers in accordance with our invention need not have uniform cell size or shape in either each or adjacent layers. That is, contiguous cells of one layer may vary in size or shape, as for example smaller near the periphery or center as desired, or different layers may have different cell sizes. Thus, the term honeycomb as used herein is generic to an apertured structure of thin metallic side walls and is not restricted to particular shaped or uniform sized apertures. While the specific examples have referred to a sensible heat exchanger in the shape of a wheel, to which the structure of this invention is particularly applicable, the structure may be advantageously used for any cyclic heat exchange process.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. An improved metallic heat exchange apparatus for use in cyclic heat exchange comprising multi-layers of metallic honeycomb each of said layers having axially parallel offset apertures and in just touching point contact with adjacent layers and retaining means for maintaining said relationship of said honeycomb layers, said multi-layer arrangement providing increased temperature gradient between the outer faces of said multi-layers.

2. The apparatus of claim 1 having three and more of said layers.

3. The apparatus of claim 2 having four to eight honeycomb layers.

4. The apparatus of claim 1 wherein said honeycomb is nonferrous metal of about 2 to 15 mils in thickness.

5. The apparatus of claim 4 wherein said honeycomb comprises hexagonal shaped contiguous cells with opposite walls being about one thirty-second to three-eights inch from each other.

6. In an open-cycle air conditioning apparatus for heating and cooling of the type comprising an enclosure defining a treatment air passageway and a separate regenerative air passageway, means for passing an air stream through each of said passageways, a sensible heat exchanger means for transfer of thermal energy from one of said passageways to the other, a desiccant means for transfer of moisture from the air treatment passageway to the regenerative air passageway and spaced toward the exhaust of the regenerative air stream from said heat exchanger means, a first evaporative cooling means near the exit of the conditioned air passageway and a second evaporative cooling means near the entrance of the regenerative air passageway, heater means in the regenerative air passageway between said sensible heat exchanger means and said desiccant means supplying heat to the regenerative air stream, the improvement wherein said sensible heat exchange means comprises multi-layers of metallic honeycomb, each of said layers having axially parallel offset apertures and in just touching point contact with adjacent layers and retaining means for maintaining said relationship of said honeycomb layers, said multi-layer arrangement providing increased temperature gradient between the outer faces of said multi-layers.

7. The apparatus of claim 6 wherein said sensible heat exchange means is wheel-shaped and has three and more of said layers.

8. The apparatus of claim 7 having four to eight honeycomb layers.

9. The apparatus of claim 6 wherein said honeycomb is nonferrous metal of about 2 to 15 mils in thickness.

10. The apparatus of claim 9 wherein said honeycomb comprises hexagonal shaped contiguous cells with opposite walls being about one thirty-second to three-eighths inch from each other.

* * * * *